US007950935B2

(12) United States Patent
Lin et al.

(10) Patent No.: US 7,950,935 B2
(45) Date of Patent: May 31, 2011

(54) ELECTRONIC DEVICE WITH COVERING LID FOR COVERING INSERT HOLE

(75) Inventors: Meng-Zhang Lin, Taipei (TW); Cheng-Chung Chu, Taipei (TW)

(73) Assignee: ASUSTek Computer Inc., Taipei (TW)

( * ) Notice: Subject to any disclaimer, the term of this patent is extended or adjusted under 35 U.S.C. 154(b) by 142 days.

(21) Appl. No.: 12/409,769

(22) Filed: Mar. 24, 2009

(65) Prior Publication Data

US 2009/0262489 A1 Oct. 22, 2009

(30) Foreign Application Priority Data

Apr. 18, 2008 (CN) ..... 2008 1 0095216
Apr. 18, 2008 (TW) ..... 97114280 A

(51) Int. Cl.
*H01R 13/44* (2006.01)

(52) U.S. Cl. ..... 439/142; 429/97

(58) Field of Classification Search ..... 439/135, 439/136, 142; 429/97, 100
See application file for complete search history.

(56) References Cited

U.S. PATENT DOCUMENTS

| | | | | |
|---|---|---|---|---|
| 5,931,513 | A * | 8/1999 | Conti | 292/87 |
| 6,183,274 | B1 * | 2/2001 | Allum | 439/135 |
| 6,305,956 | B1 * | 10/2001 | Deng | 439/138 |
| 6,406,321 | B1 * | 6/2002 | Hayashi et al. | 439/374 |
| 6,674,639 | B2 | 1/2004 | Wang et al. | |
| 6,991,490 | B1 * | 1/2006 | Su | 439/521 |
| 7,048,556 | B2 * | 5/2006 | Stanton et al. | 439/135 |
| 7,083,439 | B1 * | 8/2006 | Hayakawa et al. | 439/136 |
| 7,150,635 | B2 * | 12/2006 | Ostmoe et al. | 439/135 |
| 7,210,963 | B2 * | 5/2007 | Chintala et al. | 439/594 |
| 2007/0284229 | A1 | 12/2007 | Chen et al. | |

FOREIGN PATENT DOCUMENTS

| | | |
|---|---|---|
| CN | 1416313 | 5/2003 |
| TW | 485748 | 5/2002 |

OTHER PUBLICATIONS

English language translation of abstract of CN 1416313 (published May 7, 2003).
English language translation of abstract of TW 485748 (published May 1, 2002).

* cited by examiner

*Primary Examiner* — Thanh-Tam T Le

(57) ABSTRACT

An electronic device with a covering lid for covering an insert hole includes a housing and the covering lid. The housing includes a first surface and a second surface which are connected to each other, and the first surface includes an insert hole. The covering lid includes a covering plate and a flexible handle, and the covering plate is disposed on the first surface and covers the insert hole. A first end of the flexible handle is connected to the second surface of the housing, and a second end of the flexible handle is connected to the covering plate. A bending portion is disposed between the first end and the second end to provide spring force to the covering plate to make the covering plate move along a direction away from the insert hole automatically when the covering plate is unfolded.

15 Claims, 5 Drawing Sheets

ELECTRONIC DEVICE WITH COVERING LID FOR COVERING INSERT HOLE

This application claims the benefit of Taiwan applications Serial No. 97114280, filed Apr. 18, 2008, the subject matter of which is incorporated herein by reference.

BACKGROUND OF THE INVENTION

1. Field of the Invention

The invention relates to an electronic device and, more particularly, to an electronic device with a covering lid for covering an insert hole.

2. Description of the Related Art

Nowadays, an electronic device with single function can not meet consumers' needs any more. On current market, common PDA phones, GPS phones, music phones, or photographing phones are popular products proposed to meet the consumers' needs.

Because functions of the electronic device are become stronger and stronger, more additional insert holes are disposed on the electronic device, such as an earphone hole or a USB connector insert hole, to meet different needs. However, multiple insert holes being disposed on the surface of the electronic device not only affects the appearance of the electronic device, but also makes it hard to prevent the insert holes from dust, which further affects electrical connection later.

SUMMARY OF THE INVENTION

The invention relates to an electronic device with a covering lid for covering an insert hole. The electronic device utilizes the covering lid to hide an exposed insert hole for dustproof. A flexible handle of the covering lid includes a bending design for spring away the pulled open covering lid automatically to expose the insert hole for use. The covering lid also keeps a distance from a housing of the electronic device to prevent the insert hole from being disconnected.

The invention relates to provide an electronic device with a covering lid for covering an insert hole. The electronic device includes a housing and the covering lid. The housing includes a first surface and a second surface which are connected to each other, and the first surface includes an insert hole. The covering lid includes a covering plate and a flexible handle, wherein the covering plate is disposed on the first surface and covers the insert hole. A first end of the flexible handle is connected to the second surface of the housing, and a second end of the flexible handle is connected to the covering plate. In addition, a bending portion is disposed between the first end and the second end of the flexible handle. The bending portion is used to provide spring force to the covering plate to make the covering plate move along a direction away from the insert hole automatically when the covering plate is unfolded.

These and other features, aspects, and advantages of the present invention will become better understood with regard to the following description, appended claims, and accompanying drawings.

BRIEF DESCRIPTION OF THE DRAWINGS

FIG. 2A is a local amplification diagram showing the electronic device of FIG. 1B.

DETAILED DESCRIPTION OF THE EMBODIMENTS

Figure 1A:
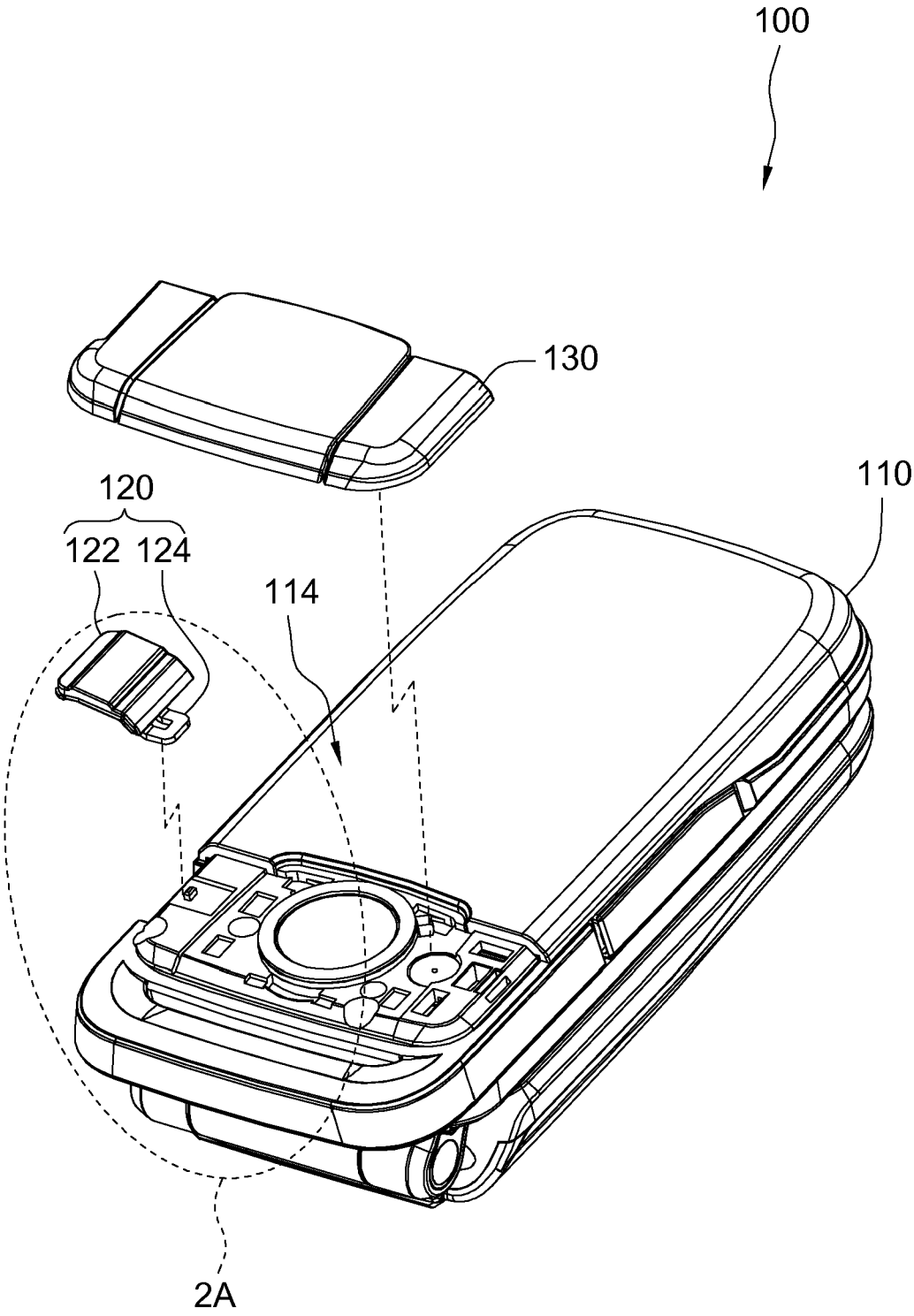
FIG. 1A and FIG. 1B are exploded diagrams showing an electronic device with a covering lid for covering an insert hole according to one embodiment of the invention from different angles.
Figure 1B:
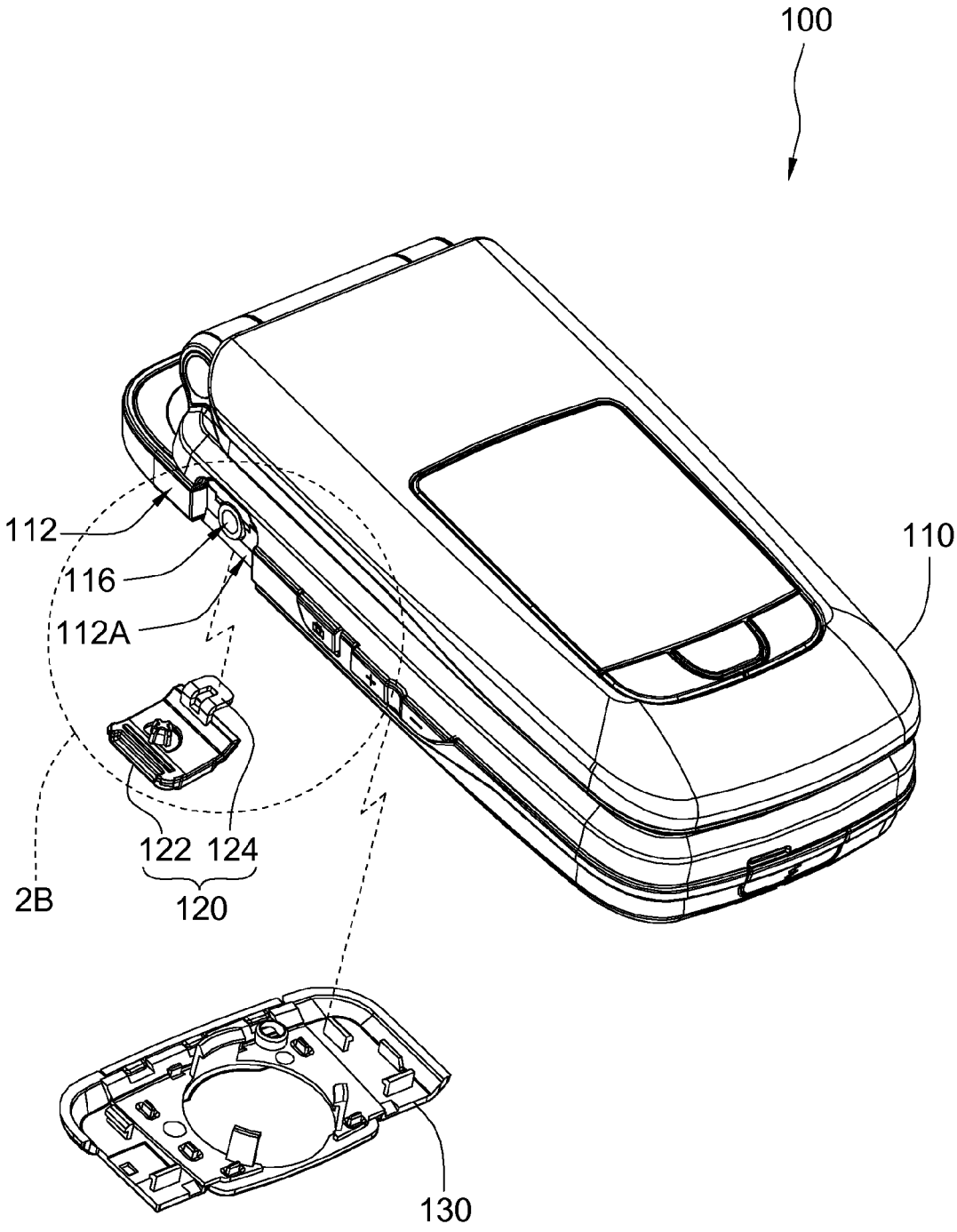

FIG. 1A and FIG. 1B are exploded diagrams showing an electronic device with a covering lid for covering an insert hole according to one embodiment of the invention from different angles. The electronic device 10 with a covering lid for covering an insert hole includes a housing 110 and the covering lid 120. The housing 110 includes a first surface 112 (shown in FIG. 1B) and a second surface 114 which are connected to each other, and the first surface 112 includes an insert hole 116 (shown in FIG. 1B). The covering lid 120 includes a covering plate 122 and a flexible handle 124, wherein the covering plate 122 is disposed on the first surface 112 and covers the insert hole 116. One end of the flexible handle 124 is connected to the covering plate 122, and the other end of the flexible handle 124 is connected to the second surface 114 of the housing 110. In addition, a bending portion 124A (shown in FIG. 2B) is disposed between two ends of the flexible handle to provide spring force to the covering plate 122 to make the covering plate 122 move along a direction away from the insert hole 116 automatically when the covering plate 122 is unfolded.

The electronic device 100 further includes a detachable plate 130 disposed on the second surface 114 of the housing 110 to hide other electronic components on the housing 110. For example, the detachable plate 130 can be an antenna cover, a battery cover, or a lens cover.

As shown in FIG. 1B, a concave portion 112A is disposed on the first surface 112 of the housing 110, and the insert hole 116 is in the concave portion 112A. Shape of the concave portion 112A is preferred similar to shape of the covering plate 122, and the covering plate 122 is contained in the concave portion 112A, which maintains the housing 110 smooth.

Figure 2A:
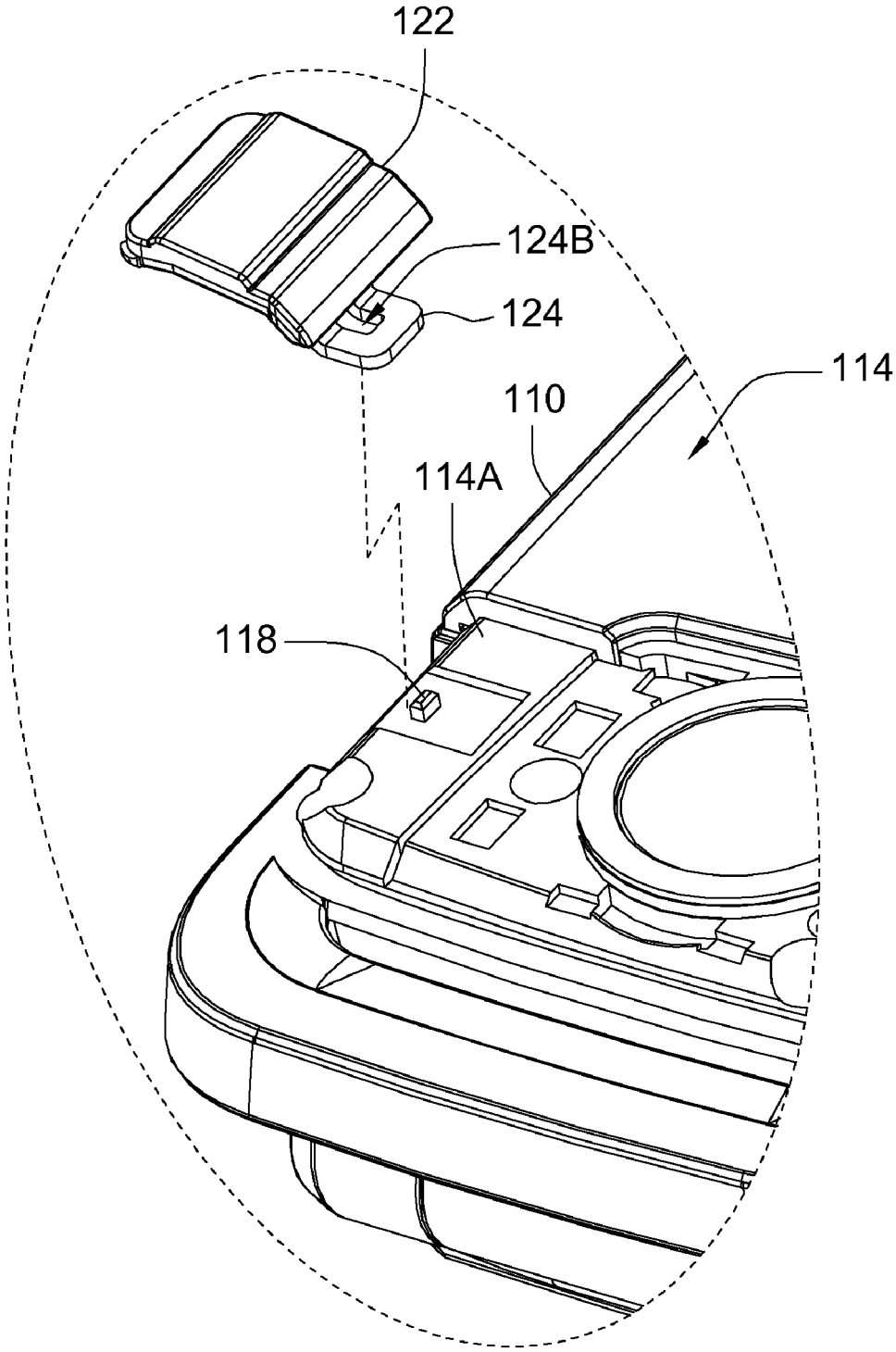
FIG. 2A is a local amplification diagram showing the electronic device of FIG. 1A.
Figure 2B:
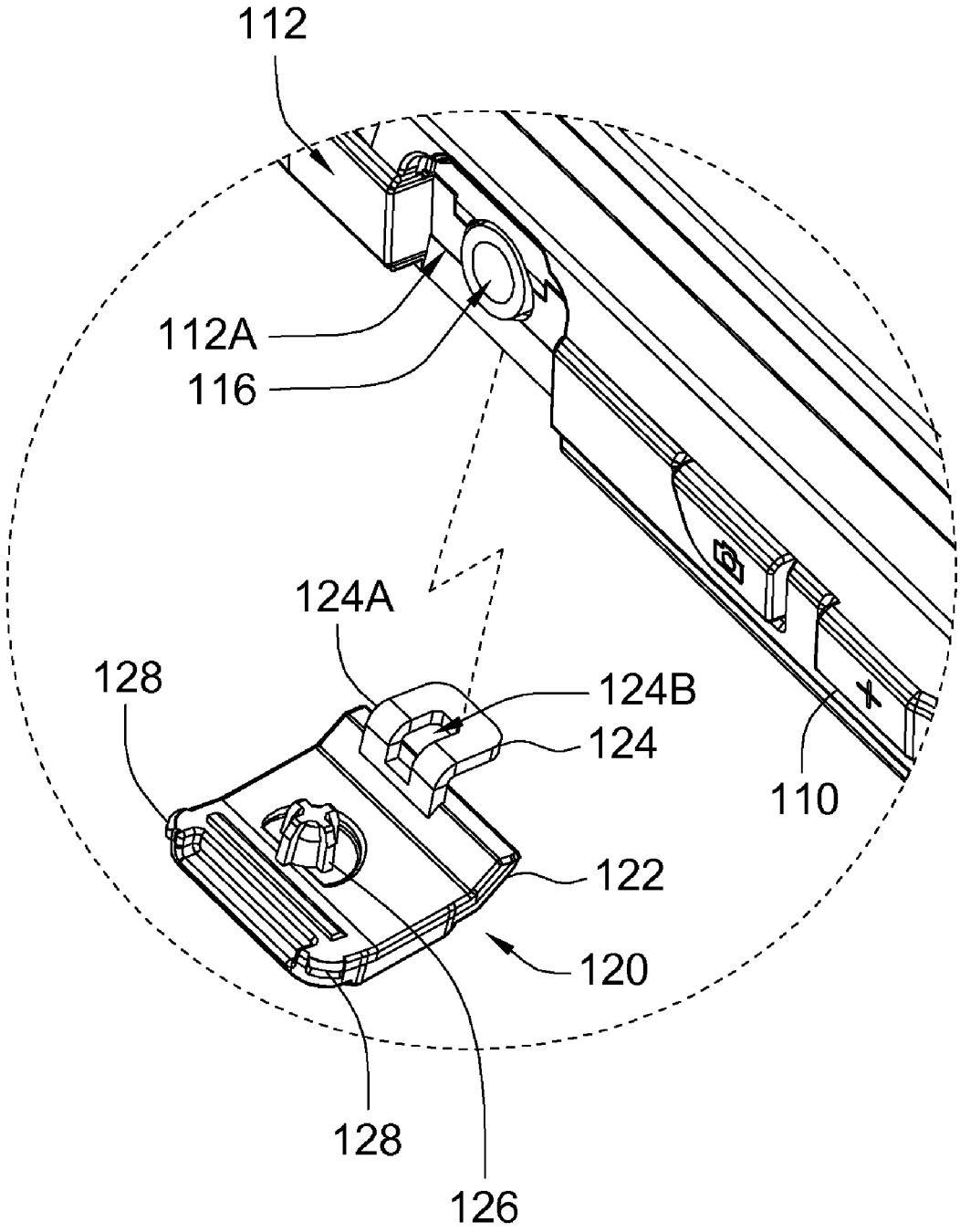

FIG. 2A is a local amplification diagram showing the electronic device of FIG. 1A, and FIG. 2B is a local amplification diagram showing the electronic device of FIG. 1B. As shown in FIG. 2A, a hook groove 114A is formed on the second surface 114 of the housing 110, and a protruding block 118 is disposed in the hook groove 114A. The protruding block 118 is inserted in a through opening 124B of the flexible handle 124, and covers the detachable plate 130 to fix one end of the flexible handle 124 on the housing 110.

As shown in FIG. 2B, the flexible handle can be L-shaped (that is, the section of the flexible handle 124 is similar to L-shaped), however, the invention is not limited, and the flexible handle 124 also can be T-shaped or inversed U-shaped. Bending angle of the bending portion is about between 45° and 90°, or 180° when the bending portion is U-shaped, and in the embodiment the bending angle of the flexible handle 124 is about 90°. The through opening 124B of the flexible handle 124 extends to the position of the bending portion 124A.

In addition, another protruding block 126 is disposed on inner surface of the covering plate 122, and the protruding block 126 is wedged into the insert hole 116 to fix the covering plate 122 on the first surface 112 of the housing 110. The shape of the concave portion 112A is similar to the shape of the covering plate 122. Therefore, a soft pad is disposed on the rim of the covering plate 122 to enforce combine strength of the covering plate 122 and the inner wall of the concave portion 112A. The shape of the covering plate 122 in the embodiment is similar to a rectangle. The embodiment is illustrated by taking that two soft pads 128 are disposed at two corners of the covering plate 122 and the soft pads 128 protrudes out of the corner rims of the covering plate 122 a little as an example. When the covering plate 122 is placed in the concave portion 112A, the soft pads 128 are extruded by the inner wall of the concave portion 112A to increase the friction force between the covering plate 122 and the concave portion 112A, and further to enforce the combine strength of the covering plate 122 and the inner wall of the concave portion 112A. In other embodiments, the number, the position, and the shape of the soft pads 128 are determined by the shape of covering plate, and the soft pads 128 are not limited to be disposed at the corner.

The flexible handle 124 and the covering plate 122 of the covering lid 120 can be integrated. The flexible handle 124 is made of soft and spring material, such as rubber or plastic, to enable the flexible handle 124 to recover resiliently after being bent. In addition, when manufactured, the protruding block 12 and the soft pads 128 also can be integrated with the covering plate 122 and the flexible handle 124.

When assembling the electronic device 100, the detachable plate 130 (shown in FIG. 1A) is disposed on the housing 110 after the covering lid 120 is fixed to the housing 110. When the detachable plate 130 is closely connected on the housing 110, it can press the flexible handle 124 to fix the covering lid 120 to the housing 110 indeed.

Figure 3A:
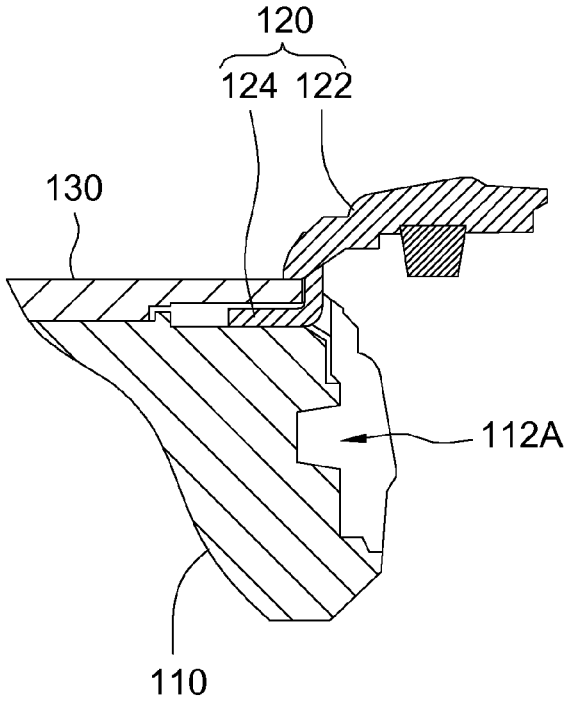
FIG. 3A is a local sectional diagram showing the assembled electronic device of FIG. 1A.
Figure 3B:
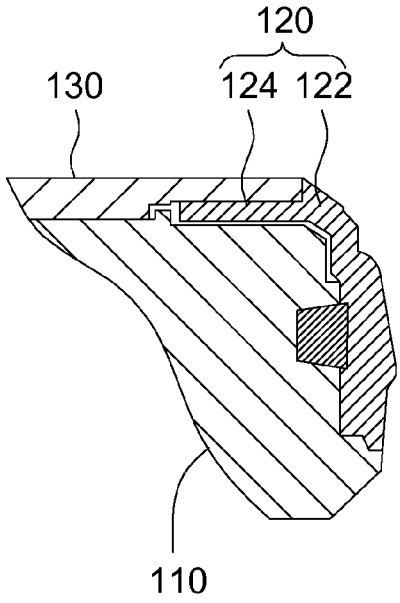
FIG. 3B is a local sectional diagram showing that the covering plate of FIG. 3A is placed in the concave portion.

FIG. 3A is a local sectional diagram showing the assembled electronic device of FIG. 1A, and FIG. 3B is a local sectional diagram showing that the covering plate of FIG. 3A is placed in the concave portion. As shown in FIG. 3A, the detachable plate 130 and the housing 110 clamp the flexible handle 124 from the top side and the bottom side respectively which can prevent the covering lid 120 falling off the housing 110. In addition, the flexible handle 124 is L-shaped, and in the natural state the flexible handle 124 makes the covering plate 122 raise up to expose the insert hole 116 (shown in FIG. 1B).

The flexible handle 124 of the covering lid 120 is of resilience and can press the covering lid 120 down to fix the covering plate 122 to the concave portion 112A of the housing 110 to hide the insert hole 116. As shown in FIG. 3A, to use the insert hole 116, the covering plate 122 is turned slightly to separate the covering plate 122 and the concave portion 112A and pulls out the covering lid 120 to make the through opening 124B of the flexible handle 124 contact with the protruding block 118. Resilience of the flexible handle 124 automatically makes the covering plate 122 turn upwards until the flexible handle 124 recovers to the natural bending state.

The insert hole 116 according to the embodiment can be an earphone hole, a USB connector insert hole, or a charger insert hole. The electronic device 110 with a covering lid for covering an insert hole according to the embodiment of the invention is to utilize the covering lid 120 to protect the originally exposed insert hole 116. The covering lid 120 is disposed to hide the unused insert hole 116 and make the electronic device 100 look better. The flexible handle 124 of the covering lid 120 includes a natural bending angle, which makes the covering lid 120 turn along a particular direction after departing from the housing 110 to expose the insert hole 116 until the flexible handle 124 recovers to the natural bending state. This can not only keep a relative position between the covering lid 120 and the housing appropriately and void surface of housing 110 being scraped by the covering lid 120, but also can decrease the occurrence number of the cases that the insert hole 116 is disconnected by the covering lid 120.

Although the present invention has been described in considerable detail with reference to certain preferred embodiments thereof, the disclosure is not for limiting the scope of the invention. Persons having ordinary skill in the art may make various modifications and changes without departing from the scope and spirit of the invention. Therefore, the scope of the appended claims should not be limited to the description of the preferred embodiments described above.

What is claimed is:

1. An electronic device with a covering lid for covering an insert hole, comprising:

a housing having a first surface and a second surface which are connected to each other, and the first surface having the insert hole; and the covering lid having a covering plate and a flexible handle, wherein the covering plate is disposed on the first surface and covers the insert hole, the flexible handle has a first end and a second end, and the first end is connected to the second surface and the second end is connected to the covering plate, wherein, a bending portion is disposed between the first end and the second end of the flexible handle, the second end of the flexible handle bends relative to the first end of the flexible handle in a direction deviating from the insert hole when the covering plate is unfolded, and the bending portion is used to provide spring force to the covering plate to make the covering plate move along a direction away from the insert hole automatically when the covering plate is unfolded.

2. The electronic device according to claim 1, wherein bending angle of the bending portion is between 45° and 90°, or 180° when the bending portion is U-shaped.

3. The electronic device according to claim 1, wherein a concave portion is disposed on the first surface of the housing, the insert hole is in the concave portion, and the concave portion is used to contain the covering plate of the covering lid.

4. The electronic device according to claim 3, wherein shape of the concave portion is consistent with shape of the covering plate.

5. The electronic device according to claim 3, wherein the covering lid further includes a soft pad on the rim of the covering plate.

6. The electronic device according to claim 5, wherein the covering plate is of a rectangle structure and the soft pad is at the corner of the rectangle structure.

7. The electronic device according to claim 1, wherein a hook groove is formed on the second surface of the housing to hook the first end of the flexible handle.

8. The electronic device according to claim 7, wherein the housing includes a first protruding block in the hook groove, the flexible handle includes a through opening, and the first protruding block passes through the through opening.

9. The electronic device according to claim 1, wherein the flexible handle is L-shaped, U-shaped, T-shaped, or inversed U-shaped.

10. The electronic device according to claim 1, wherein the covering lid further includes a second protruding block in inner surface of the covering plate, and the second protruding block is wedged into the insert hole to fix the covering plate on the first surface.

11. The electronic device according to claim 1, wherein the electronic device further comprises:

a detachable plate disposed on the second surface of the housing, wherein the flexible handle is clamped between the detachable plate and the housing.

12. The electronic device according to claim 11, wherein the detachable plate is an antenna cover, a battery cover, or a lens cover.

13. The electronic device according to claim 1, wherein the covering plate and the flexible handle are integrated.

14. The electronic device according to claim 1, wherein the flexible handle is made of rubber or plastic.

15. The electronic device according to claim 1, wherein the insert hole is a earphone hole, a USB connector insert hole, or a charger insert hole.

* * * * *